US010493474B2

(12) United States Patent
Rose et al.

(10) Patent No.: US 10,493,474 B2
(45) Date of Patent: Dec. 3, 2019

(54) TWO COMPONENT ADHESIVE SPRAY GUN AND SPRAY PATTERN

(71) Applicants: Robert J. Rose, Richmond, VA (US); Andrew T. Sinclair, Richmond, VA (US)

(72) Inventors: Robert J. Rose, Richmond, VA (US); Andrew T. Sinclair, Richmond, VA (US)

(73) Assignee: Worthen Industries, Nashua, NH (US)

( * ) Notice: Subject to any disclaimer, the term of this patent is extended or adjusted under 35 U.S.C. 154(b) by 144 days.

(21) Appl. No.: 15/380,526

(22) Filed: Dec. 15, 2016

(65) Prior Publication Data

US 2017/0173609 A1 Jun. 22, 2017

Related U.S. Application Data

(60) Provisional application No. 62/268,184, filed on Dec. 16, 2015.

(51) Int. Cl.
*B05B 7/08* (2006.01)
*B05B 1/34* (2006.01)

(52) U.S. Cl.
CPC ..... *B05B 7/0846* (2013.01); *B05B 1/3405* (2013.01)

(58) Field of Classification Search
CPC ..... B05B 7/0846; B05B 1/3405
USPC .... 239/306, 407, 413, 414, 417.5, 418, 419, 239/433, 543, 525, 536
See application file for complete search history.

(56) References Cited

U.S. PATENT DOCUMENTS 3,840,179 A * 10/1974 Krohn ..... B05B 7/0846 239/1
2015/0017327 A1* 1/2015 Myers ..... B05B 7/1209 427/207.1
2016/0312078 A1* 10/2016 Churcher ..... C09J 9/00

* cited by examiner

*Primary Examiner* — Steven J Ganey
(74) *Attorney, Agent, or Firm* — Lambert Shortell & Connaughton; Gary E. Lambert; David J. Connaughton, Jr.

(57) ABSTRACT

A two part adhesive spray system is provided herein. This system provides numerous enhancements to the prior art including limiting overspray "fog," saving on sprayed material because of a more efficient spray pattern, and providing a more efficient bond than that of the prior art. In particular, the present invention provides a spray pattern having both adhesive and activator. The activator is sprayed in a smaller spray area than the adhesive, which is sprayed on a larger area. As such, when sprayed on a substrate, the activator provides a rapid tack to hold a second adhered material to the substrate sufficient to hold it in place while the remainder of the adhesive dries and/or cures.

18 Claims, 5 Drawing Sheets

TWO COMPONENT ADHESIVE SPRAY GUN AND SPRAY PATTERN

BACKGROUND

Typically, in two part sprayed adhesive applications, an adhesive and an adhesive activator ("activator") are both sprayed onto the same surface. The adhesive is enhanced by the activator's ability to chemically destabilize the adhesive, providing nearly instant tack between two substrates, and rapid cure of the adhesive upon mixing. Without this activator, the adhesive will still work, but cures slowly and is not immediately tacky. Currently, these two part adhesive spray systems apply both the activator and the adhesive evenly to a surface to be adhered to. This ensures that the adhesive will be fully destabilized on all surfaces it is applied to. However, prior art two part adhesive spraying systems can be costly because of the quantity of activator used. Also, activator mixtures are typically very high in water content (80-97.5%). This water causes a number of problems.

Therefore, what is needed is a system that may achieve the quality of adhesion achieved by the two part adhesive spray systems while using less activator and less water to the sprayed surfaces.

SUMMARY

The subject matter of this application may involve, in some cases, interrelated products, alternative solutions to a particular problem, and/or a plurality of different uses of a single system or article.

In one aspect, a two component adhesive spray system is provided. The system may comprise a spray gun or other spray arrangement, an adhesive source connected to the gun, and an activator source connected to the gun. The spray gun may comprise a handle, with a trigger attached to the handle. The trigger controls the spraying of both adhesive and activator. The spray gun also has an adhesive inlet port and activator inlet port allowing connection between the adhesive source and activator source, respectively, to the spray gun. An adhesive housing is connected to the spray gun, the housing having a nozzle configured to atomize or otherwise spray the adhesive. An activator housing is connected to the adhesive spray gun, and spaced apart from the adhesive housing. An activator nozzle is configured to atomize or otherwise spray a quantity of activator as it passes through the activator nozzle. The activator spraying arrangement (controlled by the activator nozzle in most embodiments) is configured to provide a spray area to a substrate that is smaller in area than the adhesive spray. In a particular embodiment, the activator is sprayed at a height wise middle 5-50% of the area sprayed by the adhesive. In varying embodiments, the system may be manual (as in held by hand during use) or mechanized and controlled by a computerized or other mechanical system. Accordingly, the device of the present invention provides a spray pattern having a larger area of adhesive and a comparatively smaller area of activator.

In another aspect, a two component adhesive spray system is provided. The system comprises a first adhesive spray housing which is configured to spray an adhesive in a first spray area. The system further comprises a second activator spray housing which is configured to spray an activator in a second spray area that is smaller than the adhesive spray area. These two housings spray their respective fluids at an angle towards each other, such that the adhesive and activator are mixed either slightly before meeting the substrate or on the substrate. When configured for use, an adhesive feed source is connected to the adhesive spray housing, and an activator feed source is connected to the activator spray housing.

DETAILED DESCRIPTION

The present invention concerns a two part adhesive spray system having an adhesive spray pattern that covers a greater area than the activator spray pattern. The present invention operates by providing a two component adhesive and activator spray pattern wherein the activator is sprayed in just a portion of an area covered by the adhesive spray area. The activator, as sprayed, provides sufficient rapid adhesion and tack (such as, for example, by coagulation of the adhesive) to hold two substrates together during bonding while the remainder of the adhesive dries or cures without the use of the activator to fully secure the two substrates. This process achieves a substantial reduction in the use of costly activator and problematic and slow drying water during a two part spray adhesion process. As used herein, the term spray area applies to both a cross section of a spray in the air, and/or a surface area of a substrate.

Figure 1:
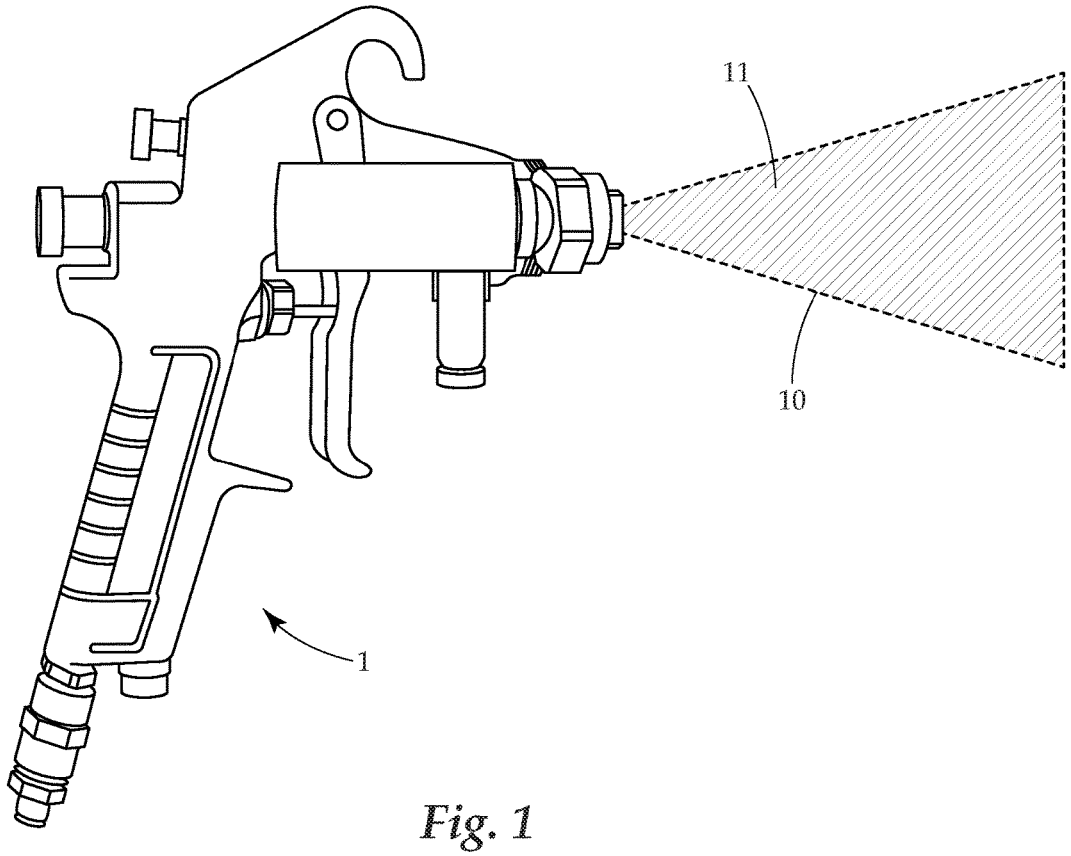
Fig. 1 (PRIOR ART)
FIG. 1 provides a view of a prior art two component adhesive spray gun and the spray pattern produced.

Turning to FIG. 1, a prior art view of a typical two component adhesive spray system is provided. The spray gun 1 has two spray housings—an adhesive spray housing and an activator spray housing, each housing having a nozzle to produce a spray. The adhesive and activator housing may be any structures that may receive spray fluid and allow spraying of the fluid. Each nozzle is configured to produce a spray in a spray area. The first adhesive spray area 10 is the same size as the second activator spray area 11. As such, the prior art spray systems cause the adhesive and activator to be sprayed over the same surface area, causing all of the adhesive to be activated, which makes it instantly tacky. While this is advantageous in providing this rapid tack, it has been found by the inventors to be excessive, leading to needless use of the activator mixture, which comprises expensive activator and problematic water (activator mixture being typically 80-97.5% water).

Figure 2:
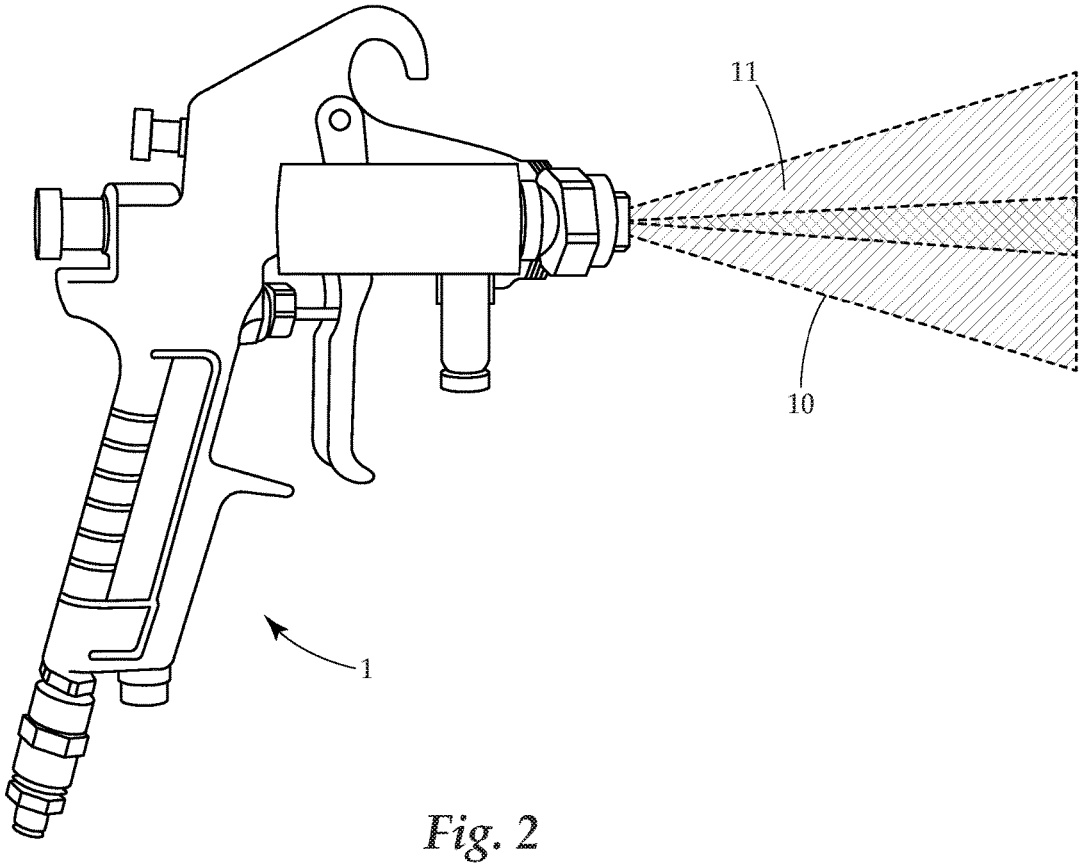
FIG. 2 provides a side view of the present invention two component adhesive spray gun and an embodiment of the spray pattern produced.

In contrast to FIG. 1, FIG. 2 provides a view of an embodiment of the present invention, which provides a wide adhesive spray, and a smaller, narrow activator spray. This results in a smaller quantity of activator use. The spray system 2 is shown here as a spray gun, however it should be understood that the spray system may be any configuration, without straying from the scope of the present invention. Here, the spray system provides two sprays, a first adhesive spray 10 having a first adhesive spray area, and a second activator spray 11 having a second activator spray area which is smaller than the first adhesive spray area. The activator 11 being sprayed in this smaller area is selected to be sufficient to provide a rapid bonding capable of holding the two substrates to be adhered (two pieces of foam, for example) together. The remainder of the adhesive may then dry at a slower pace, to eventually provide the fully secure and adhered condition once dried. This drying normally is complete in approximately 1-5 hours. In varying embodiments, the activator spray area 11 may be adjusted depending on size, weight, porosity, and other properties of the two substrates being adhered. For example, a larger activator spray area, sprayed through nozzle 12, may be used to bond heavier substrates that are likely to separate, while a small area of activator may be used for a light or non-porous material.

In some embodiments, the activator spray 11 may have a spray area that is between 5%-50% of the area sprayed with adhesive. Typical activator spray area ranges may be between 15%-33%, but as noted may vary depending on the substrates at issue. It should be understood that any area of activator spray area may be used, so long as it is of a lesser area than the adhesive spray area. For example, the activator may be sprayed over 85%, 75%, 65% etc. of the adhesive spray area, without straying from the scope of the present invention.

Figure 3:
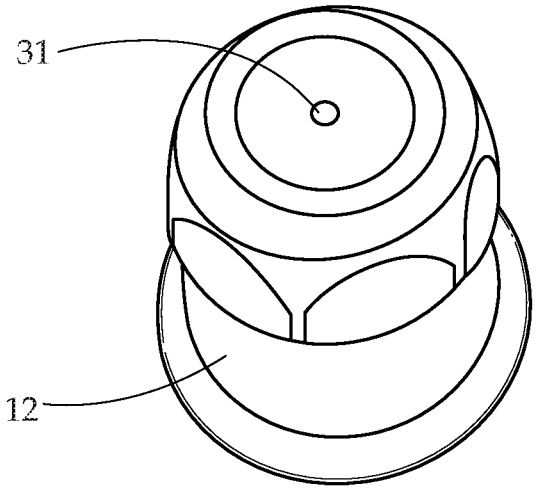
FIG. 3 provides a perspective view of an embodiment of a cone spray gun tip.
Figure 4:
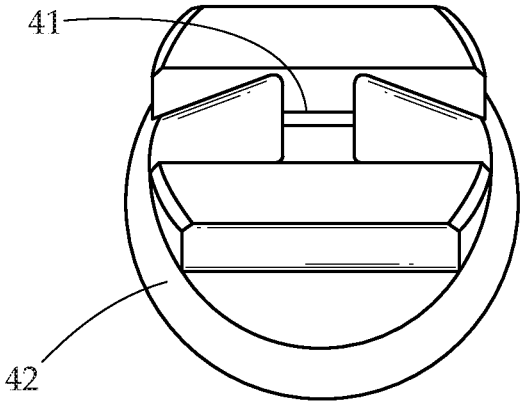
FIG. 4 provides a perspective view of another embodiment of a spray gun tip.

A two component spray gun 2 or other spray system may be configured to provide a spray pattern as shown in FIG. 2, with the activator spray 11 providing a smaller area than the adhesive spray 10 in any number of manners. A number of structural adjustments may be used to achieve this two component spray pattern. In one particular embodiment, a spray nozzle tip 12 is removably attachable to the activator spray housing. The nozzle tip 12 may be used to control the quantity and pattern of the activator spray through adjustment and/or replacement. A plurality of different activator spray nozzles 12 may be available for easy customization for different spraying requirements. These nozzles may be, for example, cone spray tips as shown in FIG. 3, airless atomizing spray nozzles as shown in FIG. 4, or an air atomized system. In other embodiments, spray area of the activator 11 may be controlled by adjustments to the pressure and/or feed flow rate of the activator.

While the embodiment of FIG. 2 is shown as a single spray gun, it should also be understood that a two component system may utilize two separate sprayers. These sprayers may be arranged as a mounted system such as a mechanized system or assembly line system. For example, a first sprayer and second sprayer may be separated from each other and directed at the same or different areas of the substrate being sprayed. In one conveying embodiment having the substrate moving with respect to the sprayers, the activator sprayer may be down stream of the adhesive sprayer, and may spray in a smaller area than that of the adhesive. For example, the activator sprayer may spray in stripes, a single small line, an S pattern, or the like. In another embodiment, a mechanized sprayer system may be used to spray both components onto a substrate.

Figure 5B:
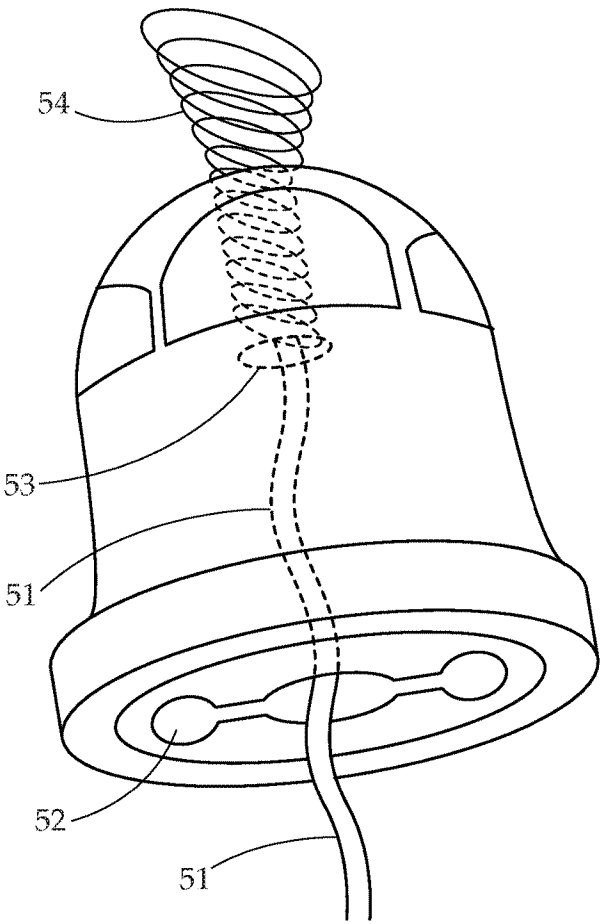
FIG. 5B provides another view of an embodiment of a conical spray tip.
Figure 5A:
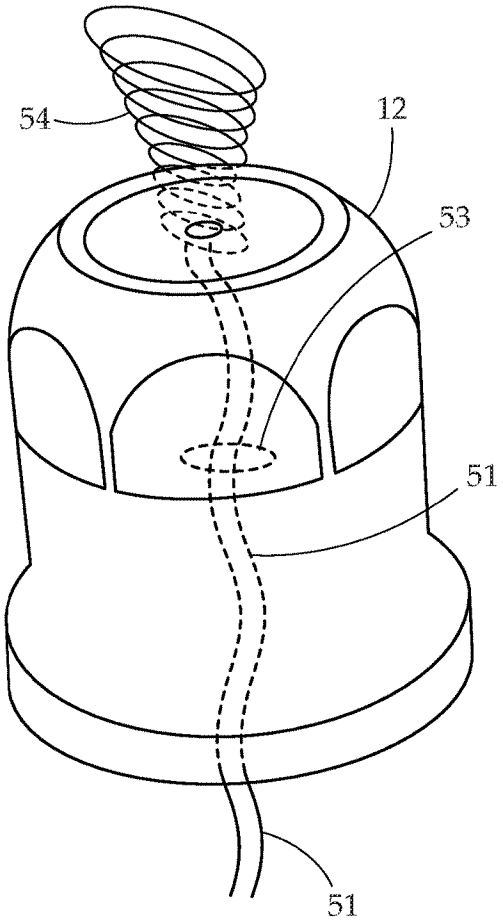
FIG. 5A provides a view of an embodiment of a conical spray tip.

A cone spray nozzle tip is shown in FIGS. 3, 5A and 5B. In such a nozzle, a conical spray pattern may be achieved. This conical pattern shape is produced by the activator fluid 51 entering a hole 52 in a side or rear of the nozzle 12. This inlet fluid 51 (activator in this case, but adhesive may be used as well) is provided under pressure and the nozzle 21 is shaped at orifices 53 such that the velocity of the fluid 51 causes a spinning of fluid 51 within the spray nozzle tip into a conical pattern. The fluid 54 is then ejected from the tip through an orifice in this conical pattern 54. Conical spray nozzle tips not only have an effect on the spray pattern, but are useful to reduce the amount of fluid (activator or adhesive) that is sprayed.

Another embodiment of a spray tip is shown by the airless spray nozzle tip of FIG. 4. This nozzle tip 42 has an orifice 41 which causes pressurized fluid from a rear of the nozzle tip 42 to be atomized while passing through the orifice 41.

Figure 6:
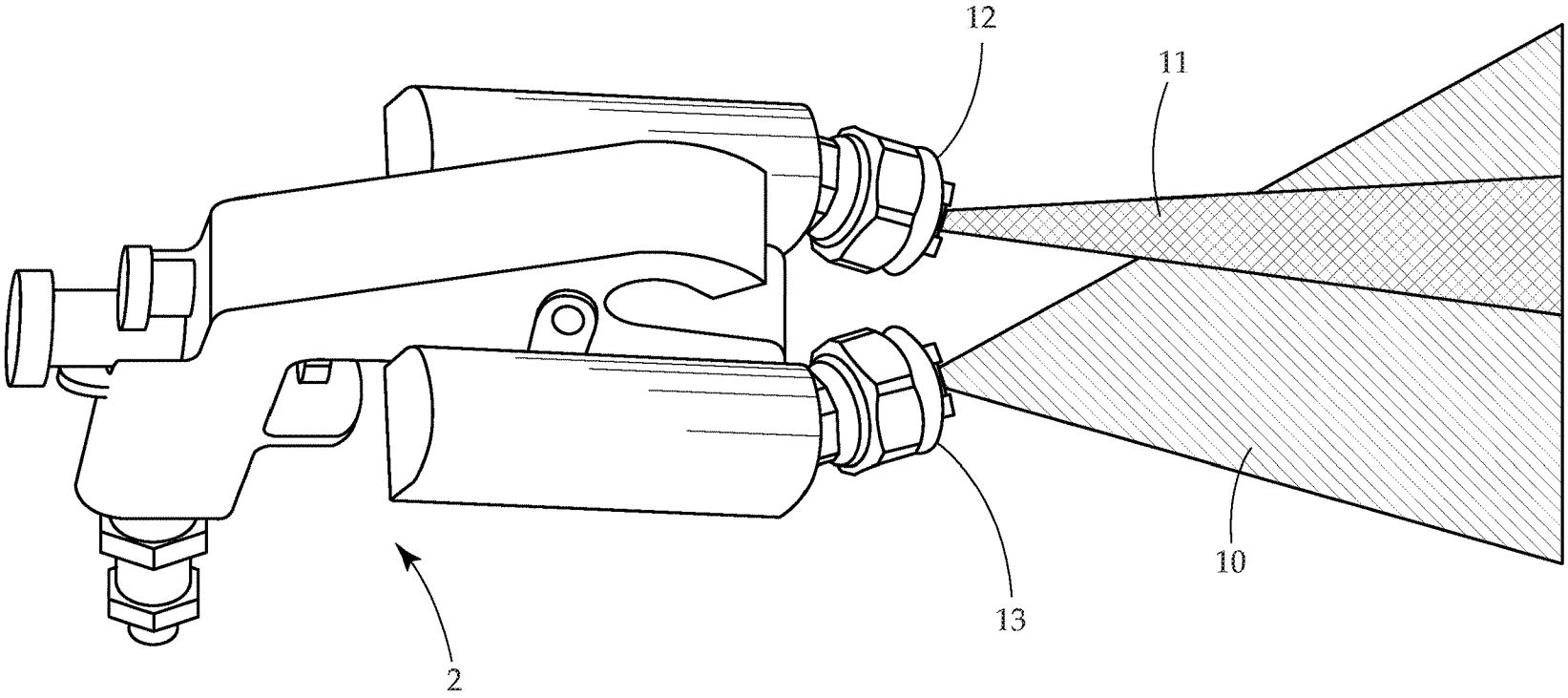
FIG. 6 provides a top perspective view of an embodiment of the spray gun of the present invention.

FIG. 6 provides a perspective view of another embodiment of the present invention. In this view, a spray gun 2 is shown. The spray gun 2 has two spray chambers, each with a spray nozzle—an activator spray nozzle 12 and an adhesive spray nozzle 13. As is shown, the activator spray area 11 is smaller than the adhesive spray area 10, as controlled by the spray gun trigger, which causes spraying from both nozzles 12, 13, simultaneously. Such nozzles have not before been used in adhesive spray guns, either air atomized, or airless embodiments. As can be seen, the nozzles 12, 13 are angled towards each other, causing the spray areas 10, 11 to overlap in the air and when reaching the substrate.

Generally, the adhesive contemplated herein may be any adhesive sprayable through a spray gun. In some embodiments, the adhesive may be selected to be a polychloroprene latex base that can have other lattices such as styrene butadiene rubber (SBR), Acrylic, Vinyl Acetate Ethylene (VAE), Poly-Vinyl Acetate (PVA), Vinyl Acrylic, Nitrile, Styrene Acrylic, Polyisoprene, Butyl Rubber, Guayule, Natural rubber and the like may be added as well. A pH of the adhesive is lowered using Glycine, or other acid such as glycolic, lactic, citric, ascorbic, boric, and the like. Stabilizers are further added. The stabilizers may be any of: anionic soaps, nonionic surfactants, polymeric thickeners, and water. In a particular embodiment, the adhesive used herein may be SprayClean® 1404, Fabond, or equivalent from Worthen Industries. In another embodiment, the adhesive may be selected to have a SBR base. This SBR based adhesive may further have other lattices such as those listed above, as well as a polychloroprene latex. In still another embodiment, the adhesive may be selected to have a natural rubber latex base. This natural rubber latex based adhesive may further have other lattices such as those listed above, as well as a polychloroprene latex.

The activator contemplated herein may be any acid or salt solution or dispersion capable of activating the adhesive component, making it highly tacky and adherent when the two mix. Examples of activators may include, but are not limited to: Acids such as: hydrochloric acid, phosphoric acid, sulfuric acid, nitric acid, boric acid, oxalic acid, acetic acid, citric acid, lactic acid, glycolic acid, propionic acid, glycine, alanine, valine, leucine, isoleucine, lycine; sulfate salts such as: zinc sulfate, potassium sulfate, sodium sulfate, magnesium sulfate, calcium sulfate, ammonium sulfate; nitrate salts such as: zinc nitrate, potassium nitrate, sodium nitrate, magnesium nitrate, calcium nitrate and ammonium nitrate; ammonium salts such as: ammonium nitrate, ammonium sulfate, ammonium chloride; chloride salts such as: zinc chloride, potassium chloride, sodium chloride, magnesium chloride, calcium chloride, and the like. These acids and salts are generally solvated in water at varying concentrations, typically at 30% or less. More typically in the range of 2 to 15%. In another embodiment, the activator may be a dispersion of sodium silicofluoride in water, or other similar dispersion.

For the present invention, the ratio by volume of adhesive to activator may be about 25:1 in the area sprayed with both adhesive and activator. More preferably approximately 10:1 (again for the area sprayed with both adhesive and activator, applicable to the remainder of the ratios discussed herein) with the best results at approximately 5:1. However, the invention will work with a ratio range of 2:1 to 50:1 adhesive to activator.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention.

What is claimed is:

1. A two component adhesive spray system comprising:

a first adhesive spray housing configured to spray an adhesive in a first spray area;

a second activator spray housing configured to spray an activator in a second spray area, the second spray area being less than the first spray area; and wherein the first adhesive spray housing and second activator spray housing are configured to spray at an angle towards the other; and wherein the second spray area is between approximately 5-50% the size of the first spray area.

2. The two component adhesive spray system of claim 1 wherein the spray housings are connected to a spray gun.

3. The two component adhesive spray system of claim 1 wherein the spray housings are connected to a mechanized spray assembly.

4. The two component adhesive spray system of claim 1 wherein at least one of the first adhesive spray housing and second activator spray housing utilize an airless spray nozzle.

5. The two component adhesive spray system of claim 4 wherein the airless spray nozzle is a conical spray tip nozzle.

6. The two component adhesive spray system of claim 1 wherein at least one of the first adhesive spray housing and second activator spray housing utilize an air atomized spray configuration.

7. The two component adhesive spray system of claim 1 wherein the second spray area is between approximately 15-33% the size of the first spray area.

8. The two component adhesive spray system of claim 1 wherein the first spray area and second spray area is directed to a foam substrate.

9. The two component adhesive spray system of claim 1 wherein the second spray area is controlled by a nozzle configuration to control the second spray area of the activator.

10. The two component adhesive spray system of claim 1 wherein the second spray area is controlled by an activator feed configuration to control the second spray area of the activator.

11. The two component adhesive spray system of claim 1 wherein the volume ratio of adhesive spray to activator spray is at a volume ratio of 25:1 to 2.5:1.

12. A two component adhesive spray system comprising:

a first adhesive spray housing configured to spray an adhesive in a first spray area;

a second activator spray housing configured to spray an activator in a second spray area, the second spray area being less than the first spray area;

wherein the first adhesive spray housing and second activator spray housing are configured to spray at an angle towards the other;

an adhesive feed source connected to the first adhesive spray housing;

an activator feed source connected to the second activator spray housing;

wherein the second spray area is between approximately 5-50% the size of the first spray area.

13. The two component adhesive spray system of claim 12 wherein the spray housings are connected to a spray gun.

14. The two component adhesive spray system of claim 12 wherein the spray housings are connected to a mechanized spray assembly.

15. The two component adhesive spray system of claim 12 wherein at least one of the first adhesive spray housing and second activator spray housing utilize an airless spray nozzle.

16. The two component adhesive spray system of claim 12 wherein the second spray area is controlled by a nozzle configuration to control the second spray area of the activator.

17. The two component adhesive spray system of claim 12 wherein the first spray area and second spray area is directed to a foam substrate.

18. The two component adhesive spray system of claim 12 wherein the volume ratio of adhesive spray to activator spray is at a volume ratio of 25:1 to 2.5:1.

* * * * *